United States Patent [19]

Richmond

[11] Patent Number: 4,911,082

[45] Date of Patent: Mar. 27, 1990

[54] DROP CENTER GONDOLA CAR

[75] Inventor: Shaun Richmond, Orland Park, Ill.

[73] Assignee: Thrall Car Manufacturing Company, Chicago Heights, Ill.

[21] Appl. No.: 341,642

[22] Filed: Apr. 21, 1989

[51] Int. Cl.[4] ..... B61D 3/00

[52] U.S. Cl. ..... 105/406.1; 105/244

[58] Field of Search ..... 105/244, 245, 246, 238.1, 105/406.1, 406.2, 409, 410, 413–421, 239

[56] References Cited

U.S. PATENT DOCUMENTS 3,240,168 3/1966 Charles et al. .
3,713,400 1/1973 Teoli .
3,772,997 11/1973 Heap et al. .
4,212,252 7/1980 Hart et al. .
4,236,459 12/1980 Teoli .
4,254,714 3/1981 Heap .
4,306,505 12/1981 Zehnder et al. ..... 105/406.1
4,331,083 5/1982 Landregan et al. .
4,408,542 10/1983 Heap .

*Primary Examiner*—Douglas C. Butler
*Attorney, Agent, or Firm*—Neuman, Williams, Anderson & Olson

[57] ABSTRACT

A gondola railway car includes a pair of draft sills and a pair of end panels extending downwardly and terminating in a flat edge portion. The flat edge portion of the end panel is connected to a shear plate by a welded connection. A shed plate is included between the side panel and the shear plate. A support bracket is included between the tub and the draft sill. Gussets are attached between the side panels and the shear plate. A top corner cap is connected to the side top chord by a welded connection and to an end top chord by a bolted connection.

9 Claims, 5 Drawing Sheets

DROP CENTER GONDOLA CAR

BACKGROUND OF THE INVENTION

1. Field of the Invention

This invention relates generally to railway cars and, more particularly, to a railway car of the open gondola type having a drop center in which the lading is loaded and unloaded from the open top of the car.

2. Description of the Prior Art

Gondola railway cars, which are open at the top, are normally employed to carry bulky granular materials such as coal, sand and gravel. Some gondola cars have a continuous center sill structure extending the length of the car and a flat floor plate on the top of the center sill. The floor plate is supported by the cross bearers which, in turn, are supported by the side structure. This structure results in a high center of gravity in the loaded car.

A variation on this conventional car is shown in U.S. Pat. No. 3,713,400 to Teoli. This type of car, known as a Teoli car in the railcar industry, has a parabolic shaped bottom between the trucks and no continuous center sill. The center sill is replaced by draft sills, or stub sills, at each end. The draft sills extend from the ends to the parabolic shaped tub portion. The draft sills are connected with the side sills at each end by separate shear plates which transfer the longitudinal forces to the sides of the car. The side structure then transmits the load along the length of the car.

A similar gondola railway car is disclosed in U.S. Pat. No. 3,240,168 to Charles. The Charles patent shows a gondola railway car with the dropped bottom between the trucks reinforced by spaced apart lateral ribs. The Charles car lacks a center sill between the rail trucks.

The various components of gondola cars are specifically designed to support and distribute the longitudinal and vertical forces of the load and the forces of leading and trailing cars. These forces are distributed to the side panels and vertical or end panels. The forces are also distributed to the draft sills and side sills as well as other support members.

One area which receives a particularly high concentration of the loading is the shear plate, or flat floor portion. The railcar is pulled in the longitudinal direction along the draft sills by the leading car and the trailing car. The load along the draft sills is reacted by the shear plate which is attached to the top of the draft sills. The load is transferred by the shear plate to the side sills and down the length of the car. The vertical distance between the longitudinal load on the draft sill and the longitudinal reaction on the shear plate creates a moment arm or torque coupling of the longitudinal forces. Despite the small moment arm distance between the two forces, the large longitudinal forces can result in an extremely powerful moment or torque coupling.

While the inside of the gondola car is utilized for structural support, it is also designed for easy removal of the granular loads of gondola cars. For example, the end panels typically include a curved portion at their bottoms in order to keep the granular material out of the corners of the inside car body. The curved bottom of the end panel, while facilitating the holding of the granular material, provides an inadequate structure to withstand the fatigue loadings encountered by the railcar during travel.

The gondola railway car of the present invention provides increased strengthening of the railcar to better support the various loadings and stresses placed on the railcar. The improved car provides support brackets to counteract the moment created by the longitudinal force on the draft sill and the reaction force on the shear plate. The improved car also includes the addition of gussets at four intersections of the side panels with the shear plate. Several other strengthening improvements are provided, including a top corner cap and the repositioning of the vertical reinforcement members.

OBJECTS OF THE INVENTION

Accordingly, it is an object of this invention to provide an improved gondola car which provides better support for the various loads and stresses placed on the car.

It is a specific object of this invention to provide a gondola car with support brackets to counteract the moment caused by the longitudinal load on the draft sill and the reaction on the shear plate.

It is a further object of this invention to provide a gondola car with gussets placed between the side panels and tub end wall to help reduce unit stresses in the region of the tub end wall near the side panels.

It is another object of this invention to provide a gondola car which eliminates the curved bottom portion of the end panel to enable the end panel to better withstand fatigue loadings.

It is another object of this invention to provide a gondola car with a top corner cap at the juncture of the end and side chords to improve the strength of the joint while allowing some movement to accommodate the twisting of the car body as it negotiates uneven track.

Other objects, advantages and features of the present invention will become apparent upon reading the following detailed description and appended claims, and upon reference to the accompanying drawings.

SUMMARY OF THE INVENTION

In accordance with one embodiment of this invention, a gondola railway car which achieves the foregoing objects includes a pair of draft sills and a car truck supporting each of the two draft sills. The car body includes a pair of end panels and a pair of side panels joined to the end panels. A car bottom is provided between the end panels and the side panels. The car bottom has two substantially flat portions, or shear plates, which extend over each of the trucks. The car bottom also includes a longitudinal trough portion, or tub, extending between the trucks or draft sills and extending below the shear plates.

Each of the end panels extends downward and terminates in a flat edge portion. The flat edge portion of the end panel is connected to the shear plate by a welded connection. The flat edge portion strengthens the connection and the ability of the connection to resist fatigue loading. A shed plate is included between the end panel and the shear plate to assist the removal of granular material from the car by preventing granular material from lodging into the corners of the car body. Reinforcing members or support brackets are included between the tub and the draft sill to provide a torque reaction to the moment produced by the longitudinal force on the draft sill and the reaction of the shear plate. Gussets are attached between the side panels and the tub end wall to provide increased strength and assist in the distribution of forces from the tub end to the side panels. A top corner cap is connected to the side top chord by a welded connection and to an end top chord by a bolted connection. The top corner cap provides increased strength in the connection between the end panels and side panels while still permitting some relative movement during the twisting of the car.

BRIEF DESCRIPTION OF THE DRAWINGS

For a more complete understanding of this invention, one should refer to the preferred embodiment illustrated in greater detail in the accompanying drawings and described below by way of an example of the invention. In the drawings.

DETAILED DESCRIPTION OF THE DRAWINGS

Figure 1:
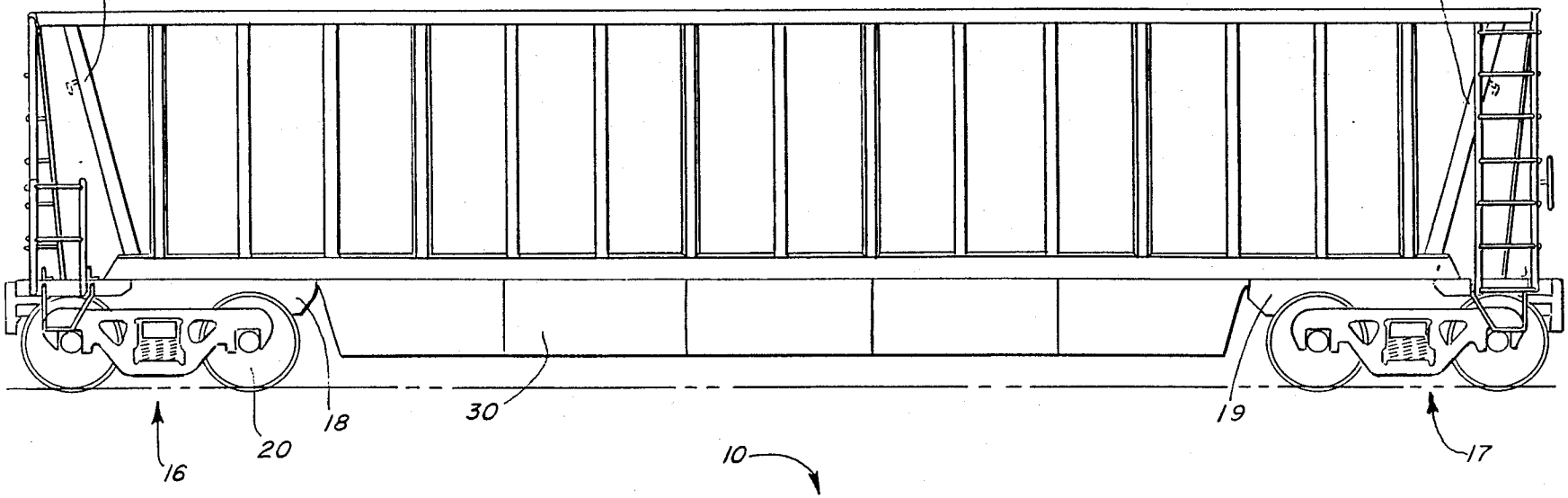
FIG. 1 is a side elevational view of the gondola railway car of the present invention.
Figure 2:
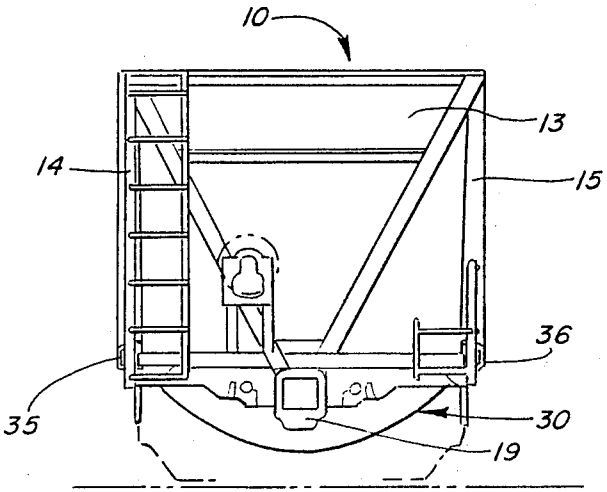
FIG. 2 is an elevation view of the front end portion of the gondola railway car of FIG. 1.
Figure 4:
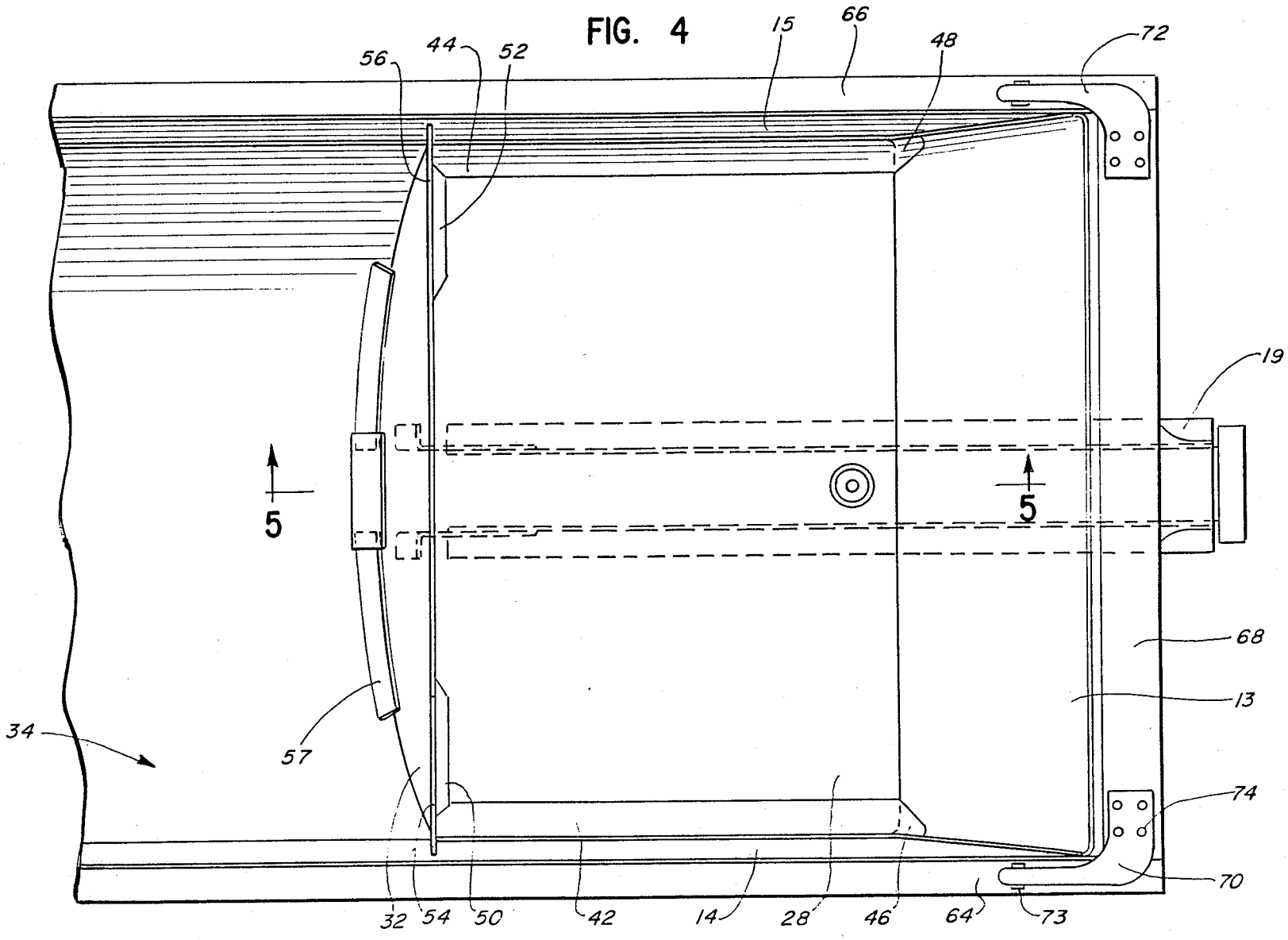
FIG. 4 is a plan view of the portion of the railway car shown in FIG. 3.

Turning now to the drawings, FIGS. 1 and 2 show the gondola railway car of the present invention generally at 10. The car has a pair of end panels 12,13 and a pair of side panels 14,15. The side and end panels slope outwardly as they extend upwardly. The side panels are shown more clearly in FIG. 4. This structure facilitates discharge of granular material from the car. Car trucks 16, 17 at both ends of the car provide support for a pair of draft sills 18, 19. The trucks include wheel assemblies 20.

Figure 3:
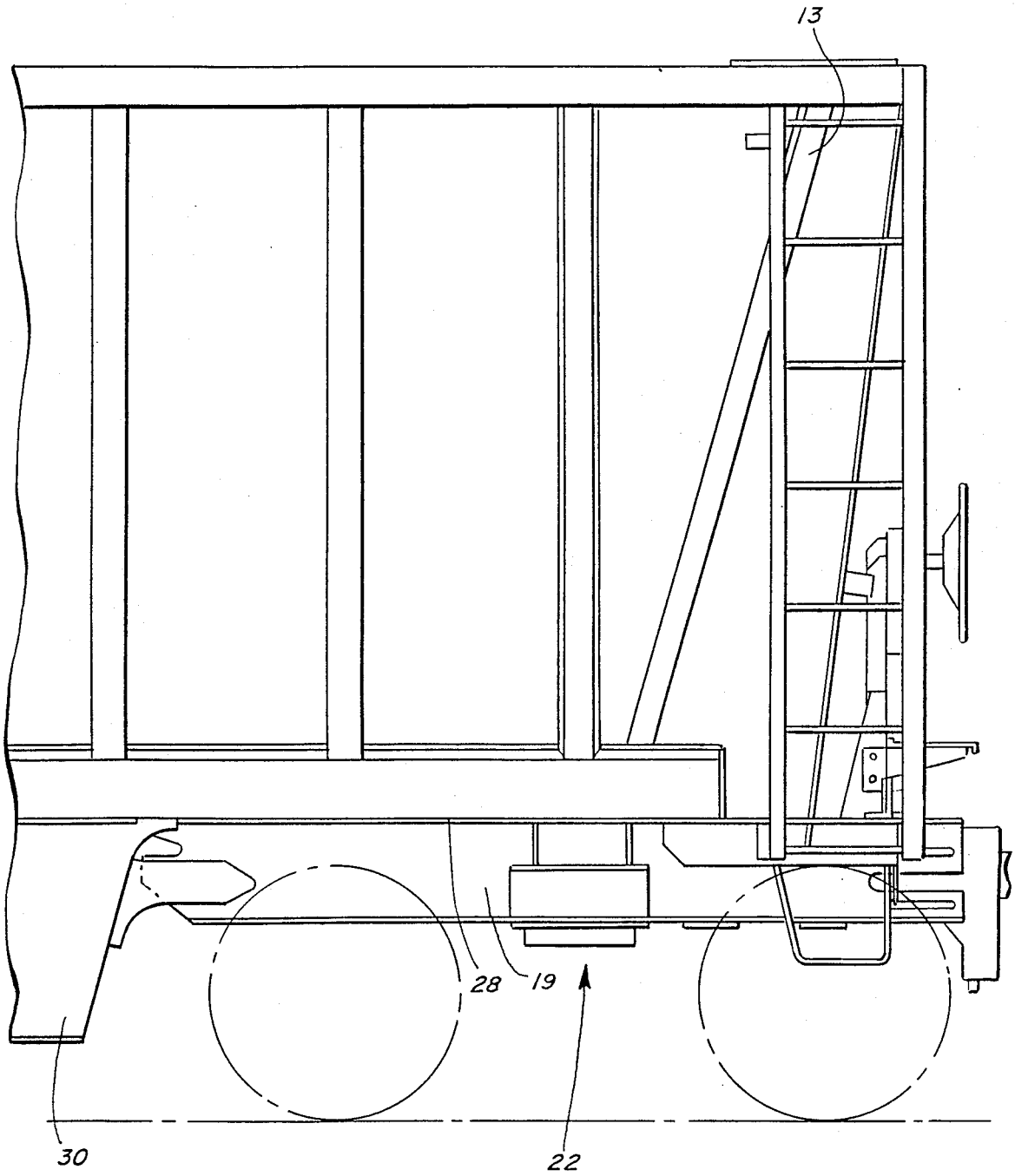
FIG. 3 is a side elevational view showing details of the portion of the railway car of FIG. 1.
Figure 5:
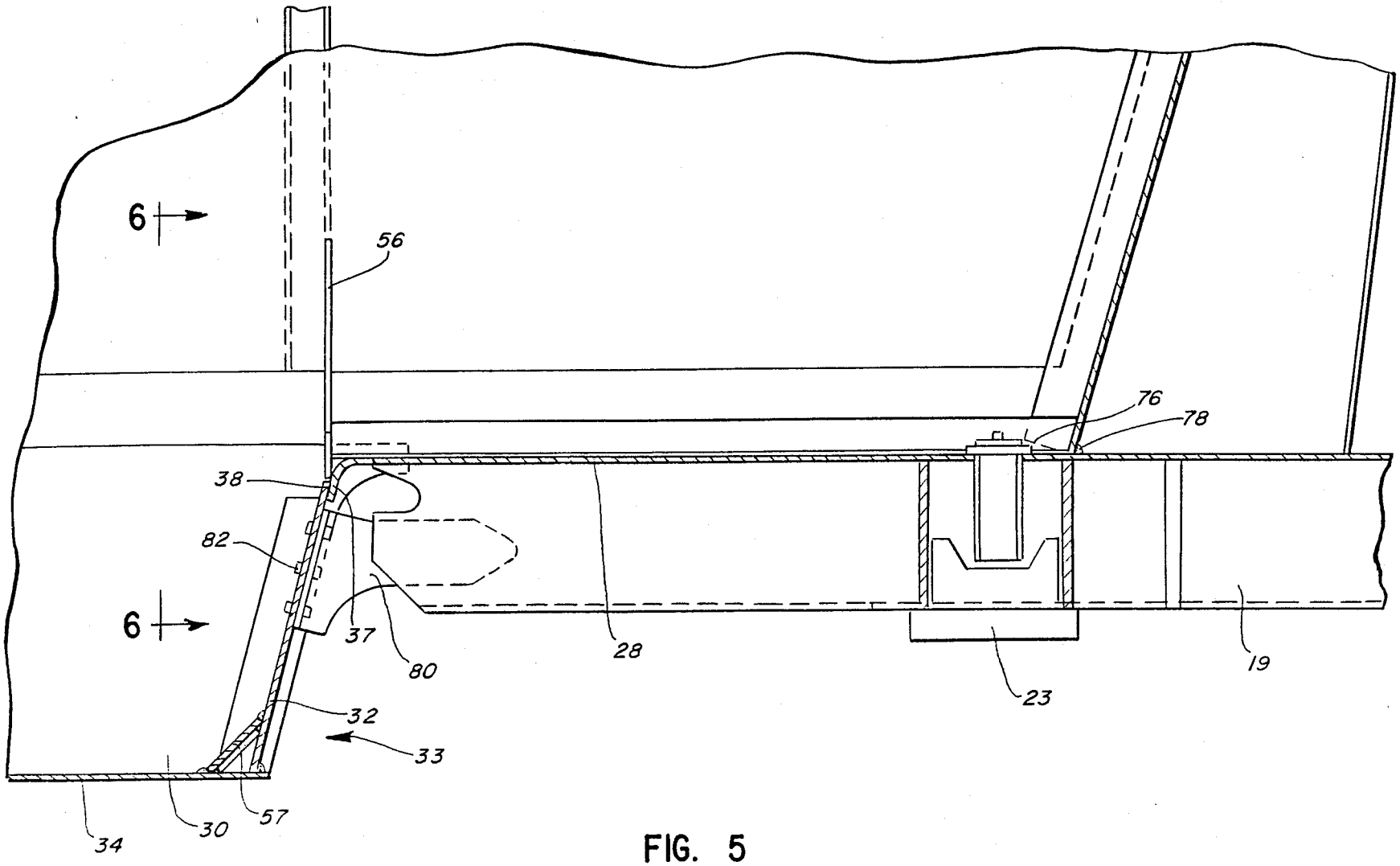
FIG. 5 is a sectional view taken along the line 5—5 of FIG. 4.

The trucks each include a bolster, which is shown generally at 22 in FIG. 3. The railcar body includes a horizontal plate 23, shown in FIG. 5, which sits within the truck bolster 22. In this manner, the trucks support the draft sills 18, 19.

At one end of the car 10 is the draft sill 18. A shear plate 28 extends above the draft sill and forms the flat portion of the railcar floor. The draft sill extends along the longitudinal center of the car body from the end to the tub 30. A similar draft sill 1 extends from the other end of the car to the opposite side of the tub, with a similar shear plate (not shown) located above. The tub 30 is of generally parabolic shape and forms a portion of the floor of the car. A tub plate 32 extends upward along the outer periphery of front portion 33 of the tub 30 from the base 34 of the tub to the shear plate 28. The base 34 forms the parabolic bottom of the tub.

The draft sills 18, 19 serve as the foundation support for the railcar body. The shear plate 28 is secured to the top of the draft sill 18 and acts as a reaction to longitudinal loads placed on the draft sill. The shear plate acts to distribute the reaction loads to the side sills 35, 36 and along the length of the car. One side sill 35 is shown in more detail in FIG. 6. The shear plate 28 includes a bent portion 37 along its edge, which is more clearly shown in FIGS. 6 and 7. Along the top of tub plate 32, the bent portion 37 is welded to the upper edge 38 of the tub plate 32. At other portions of the tub, the bent portion 37 of the shear plate is welded to the upper edge 40 of the tub 30, as shown in FIG. 7.

At the base of side panels 14, 15 between the side panels 14, 15 and the shear plate 28, are a number of side valley or side shed plates 42, 44. The side shed plates 42, 44 are connected to the side panels by a welded connection. Corner portions 46, 48 of the shed plates extend to connect the end panel 13. The sloped side shed plates provide a curved surface that facilitates the removal of coal and other granular materials from the car.

Two additional gusset shed plates 50, 52 are provided between the side shed plates 42, 44 and a pair of gussets 54, 56. The gusset shed plates provide the same function as the side shed plates. A shed plate 57 is also provided between the base of the tub and the tub plate.

Figure 7:
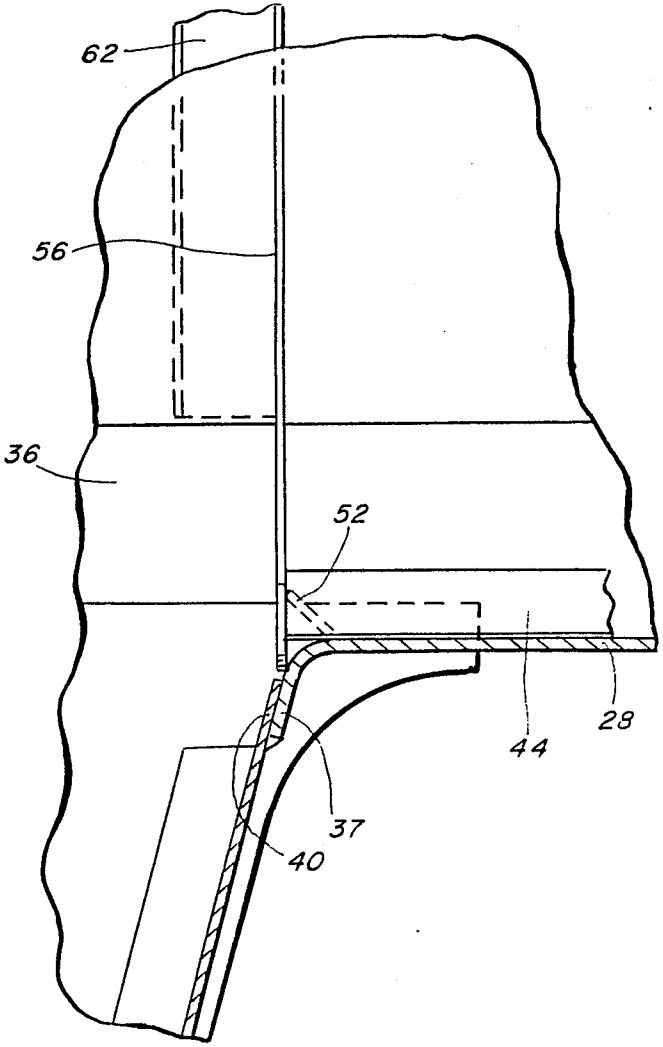
FIG. 7 is a sectional view taken along the line 7—7 of FIG. 6.
Figure 6:
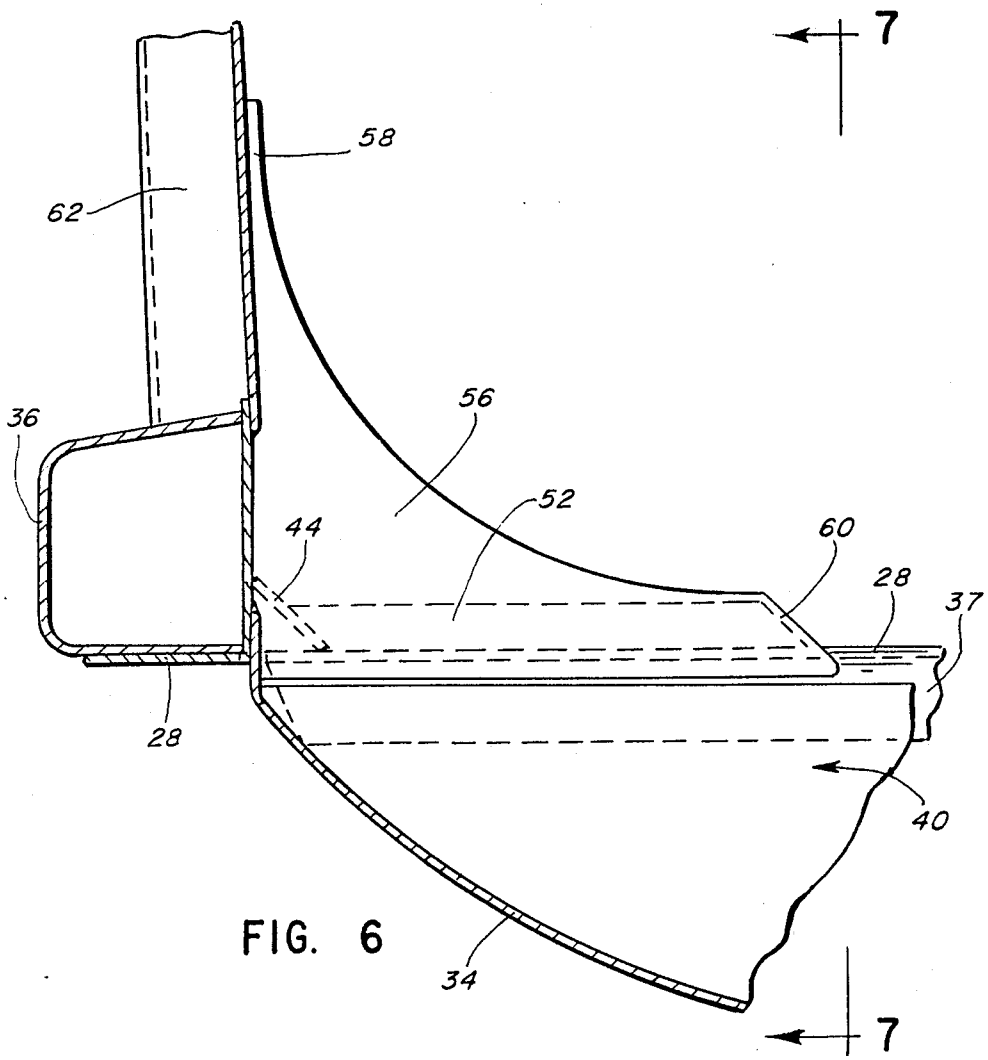
FIG. 6 is a sectional view taken along the line 6—6 of FIG. 5.

Gusset 56 and gusset shed plate 52 are shown in FIGS. 6 and 7. The gusset 56 extends between side panel 15, at its vertical portion 58, and the bent portion 37 of shear plate 28, at its horizontal portion 60. The vertical portion 58 of gusset 56 is welded to vertical side post 62. Four gussets are provided within the car body at the four corners of the upper edge of the tub. The side post 62 is positioned to provide support for the gusset. A side sill 36 also extends laterally of the gusset 56 along the side of the car body. The side sill 36 is located along the top of the shear plate 28.

At the top of the side panels 14, 15 are channel members which constitutes upper side chords 64, 66. Similarly, at the top of end panel 13 is a channel member which constitutes an upper end chord 68. Top corner caps 70, 72 extend between the upper end chord 68 and the upper side chords 64, 66. The top corner caps 70, 72 are connected to the upper side chords 64, 66 by a welded connection, shown at 73. The top corner cap is connected to the upper end chord 68 by a plurality of bolts 74. Bolts 74 are utilized in lieu of welding 73 along one upper chord in order to allow some flexing and relative movement of the panels. The top corner cap serves to strengthen the side and end panels.

The end panel 13 extends downward from the upper end chord 68 and terminates in a flat end portion 76. The flat end portion is shown most clearly in FIG. 5. The end panel 13 is connected to the shear plate 28 by a welded connection 78 at the flat end portion 76.

A support bracket 80 or reinforcing member is provided along the base of the railcar. The support bracket 80 serves as the connection between the tub 30 and the draft sill 19. The support bracket 80 is connected to the tub 30 by bolts 82 along tub plate 32. The support bracket 80 is connected to the draft sill 19 by a welded connection. In total, four support brackets are located along the base of the car.

In the operation of the railcar, the various support structures that have been described act to assist in providing the necessary opposition and reaction to the forces on the railcar. The top corner caps 70, 72 provide increased strength in the connection between the end panels and the side panels. The bolted connection in the top corner cap allows some relative movement between the panels during twisting of the railcar body while providing a reaction force.

The support bracket 80 provides a reaction to the couple produced by the longitudinal forces on the draft sill and the reaction forces of the shear plate. The vertical distance between the draft sill and the shear plate produces a large moment which is counterbalanced by a vertical force in the support bracket connection between the tub and the draft sill and a vertical force in the end panel.

The gussets 56 provide increased strength and assist in the distribution of the forces from the shear plate to the side panels. Increased support for the gusset is provided by the location of the side post 62 along the vertical portion of the gusset.

The probability of fatigue failure in the end panel is reduced by the flat end portion of the end panel. The use of a welded connection of a flat end portion, as opposed to the curved end portion used in the prior art, strengthens the connection and the ability to resist fatigue failure. The addition of shed plates along the panels also assists the removal of granular materials from the car.

While one preferred embodiment of the invention is illustrated, it will be understood that the invention is not limited to this embodiment. Those skilled in the art to which the invention pertains may make modifications and other embodiments employing the principles of this invention, particularly upon considering the foregoing teachings.

What is claimed is:

1. A gondola railway car comprising:
a pair of draft sills;
a car truck operatively connected to each of said draft sills;
a pair of end panels;
a pair of side panels joined to said end panels;
a car bottom between said end panels and said side panels having a substantially flat floor portion over each of said trucks and a longitudinal tub portion between said trucks and extending below said flat floor portion; and,
at least one of said end panels extending downwardly and terminating in a flat edge portion, said flat edge portion being operatively connected to said flat floor portion of said car bottom.

2. A gondola railway car comprising:
a pair of draft sills;
a car truck attached to each of said draft sills;
a pair of end panels;
a pair of side panels joined to said end panels;
a car bottom between said end panels and said side panels having a substantially flat floor portion over each of said trucks and a longitudinal tub portion between said trucks and extending below said flat floor portion; and,
a support bracket member operatively connected between said tub portion and at least one of said draft sills.

3. The gondola railway car of claim 2 wherein said tub portion includes a tub plate along a portion of its outer periphery; said support bracket member being connected to said tub plate by a bolted connection; said support bracket member being connected to said draft sill by a welded connection.

4. A gondola railway car comprising:
a pair of draft sills;
a car truck attached to each of said draft sills;
a pair of end panels;
a pair of side panels joined to said end panels;
a car bottom between the end and side panels having a substantially flat floor portion over each of said trucks and a longitudinal tub portion between said trucks and extending below said flat floor portion; and,
a gusset member attached between at least one of said side panels and said flat floor portion.

5. The gondola railway car of claim 4 wherein said flat floor portion includes a bent portion disposed above said tub portion, said gusset member being attached to said bent portion.

6. The gondola railway car of claim 4 wherein at least one shed plate is operatively connected between said gusset member and said flat floor portion.

7. The gondola railway car of claim 6 wherein a vertical side post is aligned with said gusset member.

8. A gondola railway car comprising:
a pair of draft sills;
a car truck attached to each of said draft sills;
a pair of end panels;
a pair of side panels joined to said end panels;
a car bottom between the end and side panels having a substantially flat floor portion over each of said trucks and a longitudinal tub portion between said trucks and extending below said flat floor portion;
each of said side panels having a side top chord; each of said end panels having an end top chord;
at least one top corner cap, said top corner cap operatively connected to said side top chord by a welded connection; and,
said top corner cap operatively connected to said end top chord by a bolted connection.

9. A gondola railway car comprising:
a pair of draft sills;
a car truck attached to each of said draft sills;
a pair of end panels;
a pair of side panels joined to said end panels;
a car bottom between the end and side panels having a substantially flat floor portion over each of said trucks and a longitudinal tub portion between said trucks and extending below said flat floor portion;
at least one of said end panels extending downwardly and terminating in a flat edge portion, said flat edge portion being operatively connected to said flat floor portion by a welded connection;
a support bracket member operatively connected between said tub portion and at least one of said draft sills;
a gusset member attached between at least one of said side panels and said flat floor portion; and,
each of said side panels having a side top chord; each of said end panels having an end top chord; at least one top corner cap, said top corner cap operatively connected to said side top chord by a welded connection, said top corner cap operatively connected to said end top chord by a bolted connection.

* * * * *